US005424761A

United States Patent [19]

Imai

[11] Patent Number: 5,424,761

[45] Date of Patent: Jun. 13, 1995

[54] COVER MEMBER FOR AN OPTICAL FIXING LAMP

[75] Inventor: Ryo Imai, Tokyo, Japan

[73] Assignee: Fuji Photo Film Co., Ltd., Kanagawa, Japan

[21] Appl. No.: 30,541

[22] Filed: Mar. 12, 1993

[30] Foreign Application Priority Data

Mar. 12, 1992 [JP] Japan ..... 4-053901

[51] Int. Cl.[6] ..... B41J 2/32; B41M 5/26; B41M 5/28; B41M 5/34

[52] U.S. Cl. ..... 347/212; 430/348; 430/141; 430/146; 347/222; 347/220

[58] Field of Search ..... 346/1.1, 76 R, 76 PH, 346/108, 76 L; 400/120; 430/146, 348, 141

[56] References Cited

U.S. PATENT DOCUMENTS 5,216,438 6/1993 Nakao et al. ..... 346/76 PH

FOREIGN PATENT DOCUMENTS 0038823 2/1993 Japan ..... 346/76 PH
0038824 2/1993 Japan ..... 346/76 PH

*Primary Examiner*—Huan H. Tran

[57] ABSTRACT

A direct thermal printer is provided having a lamp cover member which is attached to an open end of an optical fixing device, for protecting a thermosensitive recording medium from contacting a lamp of the optical fixing device. The lamp cover member is formed with a plurality of openings for reducing the absorption of light into the lamp cover member. All edges of the openings are not parallel to the recording medium transporting direction.

17 Claims, 4 Drawing Sheets

COVER MEMBER FOR AN OPTICAL FIXING LAMP

BACKGROUND OF THE INVENTION

1. Field of the Invention

The present invention relates to a direct thermal printer which records images on a thermosensitive recording medium, and more particularly to a thermal printer wherein the thermosensitive recording medium is prevented from contacting light sources which are used for optical fixing of the thermosensitive recording medium.

2. Related Art

A direct thermal printer uses a thermosensitive recording medium having a thermosensitive layer formed on a supporting material. The thermosensitive layer is color-developed when heated directly by a thermal head. Because the thermosensitive layer still has a capacity of color-developing after the thermal printing of an image on the thermosensitive recording medium, it is possible that unnecessary parts of the thermosensitive recording medium are developed if a certain amount of heat energy is accidentally applied thereto. Therefore, the thermosensitive recording medium is exposed to electromagnetic rays, such as ultraviolet rays, after the thermal printing, so as to optically fix or neutralize the color-developability.

Also a thermosensitive color recording medium having three thermosensitive color recording layers of magenta, cyan and yellow is known, for example, in U.S. Pat. Nos. 4,734,704 and 4,833,488 (corresponding to Japanese Laid-open Patent Application No. 61-213169). The thermosensitive color recording layers are formed on one another on a supporting material, and a full-color image is recorded by sequentially developing the coloring layers in magenta, cyan and yellow.

Specifically, if the yellow recording layer is disposed on the top, yellow pixels of the full-color image are first recorded by developing this layer. Thereafter, the second layer from the top, for example, the magenta recording layer is developed to record magenta pixels of the full-color image. In order to prevent the yellow recording layer from being developed during the magenta pixel recording, optical fixing of the yellow recording layer is performed by exposing the thermosensitive color recording medium to electromagnetic rays, for example, near-ultraviolet rays of 420 nm. The magenta recording layer is also optically fixed after the magenta pixel recording, for example, by projecting ultraviolet rays of 65 nm onto the color recording medium.

The ultraviolet lamp used for the above-described optical fixing is disposed as close to the thermosensitive recording medium as possible, so that the effective amount of light projected from the ultraviolet lamp onto the thermosensitive recording medium is increased and the efficiency of the optical fixing is improved. For example, the distance between the ultraviolet lamp and the thermosensitive recording medium, which is wound on the platen drum, is conventionally set at about 5 mm.

Because the thermosensitive recording medium is secured at its leading end to the platen drum, but the trailing end is not secured, it is possible for the thermosensitive recording medium to be removed off of the platen drum from the trailing end and to contact the ultraviolet lamp. The part of the recording medium which contacts the ultraviolet lamp may be developed by heat energy radiated from the ultraviolet lamp.

In view of the foregoing, a primary object of the present invention is to provide a direct thermal printer wherein the thermosensitive recording medium is prevented from being contacted with a lamp of an optical fixing device.

Another object of the present invention is to provide a direct thermal printer wherein the distance between the thermosensitive recording medium and an optical fixing lamp is maintained at a constant distance.

SUMMARY OF THE INVENTION

To achieve the above and other objects, the present invention provides a lamp cover member. The lamp cover member is disposed between a lamp of an optical fixing device and a thermosensitive recording medium wound on a platen drum, so as to prevent the thermosensitive recording medium from contacting the optical fixing lamp and from being developed by heat energy from the optical fixing lamp, even when the thermosensitive recording medium becomes unwound or loose.

The lamp cover member is formed with a plurality of openings whose edges are not parallel to the direction of transport for the thermosensitive recording medium during the optical fixing. According to this construction, absorption of light projected from the optical fixing lamp into the lamp cover member is reduced, and the recording medium is approximately exposed uniformly to the light from the optical fixing lamp.

BRIEF DESCRIPTION OF THE DRAWINGS

Other objects and advantages of the present invention will become apparent in the following detailed description of the preferred embodiments when read in connection with the accompanying drawings, wherein like reference numerals designate like or corresponding parts throughout the several views, and wherein.

DETAILED DESCRIPTION OF THE PREFERRED EMBODIMENTS

Figure 1:
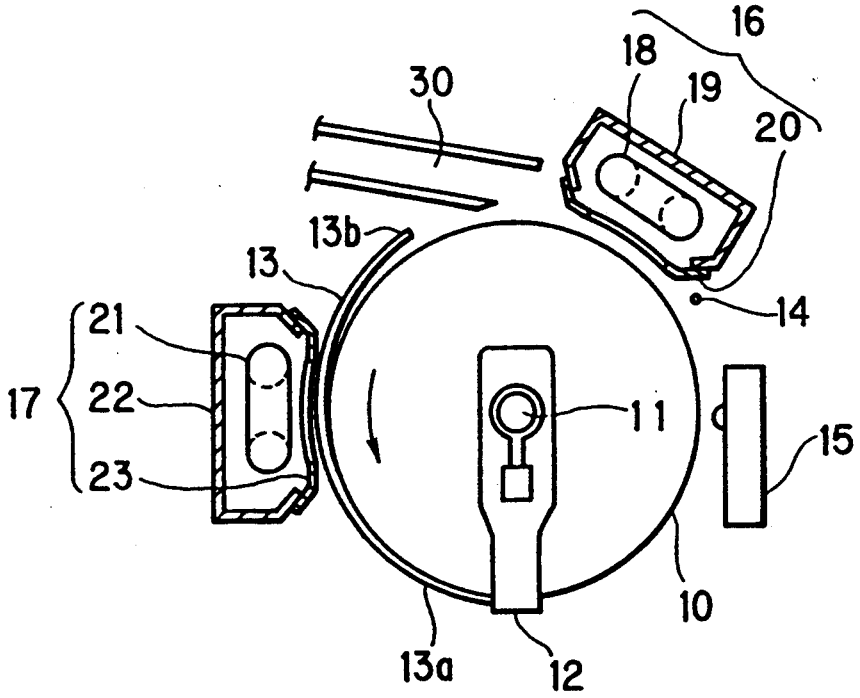
FIG. 1 schematically shows the overall construction of a direct color thermal printer for an embodiment of the present invention.

In FIG. 1, a platen drum 10 is driven to rotate by a pulse motor, which is not shown in the drawings but is connected to a drive shaft 11 of the platen drum 10. A thermosensitive color recording medium 13, hereinafter referred to simply as a recording paper, is tightly mounted on the periphery of the platen drum 10, and is transported by the platen drum 10 in a paper transporting direction shown by an arrow, during the printing.

One end 13*a* of the recording paper 13, that is the leading end with respect to the paper transporting direction, is secured to the platen drum 10 by a clamp member 12, while the trailing end 13*b* of the recording paper 13 is not secured.

A stopper 14 is provided for stopping the clamp member 12 when the clamp member 12 is released from the recording paper 13 for ejecting the recording paper 13 after printing.

A thermal head 15 is disposed in a print position. The thermal head 15 has an array of heating elements arranged in a primary scanning direction which is perpendicular to the paper transporting direction. The heating elements each individually radiate an amount of heat energy which is variable according to the color density of the pixel to be recorded.

Optical fixing devices 16 and 17 are disposed in downstream positions of the print position with respect to the paper transporting direction, for fixing a magenta recording layer 7 and a yellow recording layer 8 of the recording paper 13, respectively.

Figure 2:
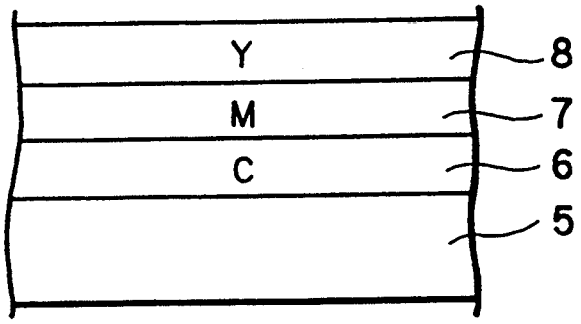
FIG. 2 schematically shows a partial section of a thermosensitive color recording medium.

FIG. 2 shows an example of the recording paper 13, wherein a cyan recording layer 6 developed in cyan, the magenta recording layer 7 developed in magenta, and the yellow recording layer 8 developed in yellow are formed on a supporting material 5 in this order from the bottom. Imaging in these recording layers 6 to 8 are sequentially performed from the top layer. Therefore, if it is desired to record magenta pixels first and then yellow pixels, the magenta recording layer 7 should be placed above the yellow recording layer 8.

The magenta recording layer 7 loses its capacity to develop color when it is exposed to ultraviolet rays of about 365 nm, because a diazonium salt compound contained therein is photochemically decomposed by this range of ultraviolet rays. The yellow recording layer 8 also is optically fixed and thus loses its color developability when it is exposed thee near ultraviolet rays of about 420 nm (blue-violet rays).

Figure 3:
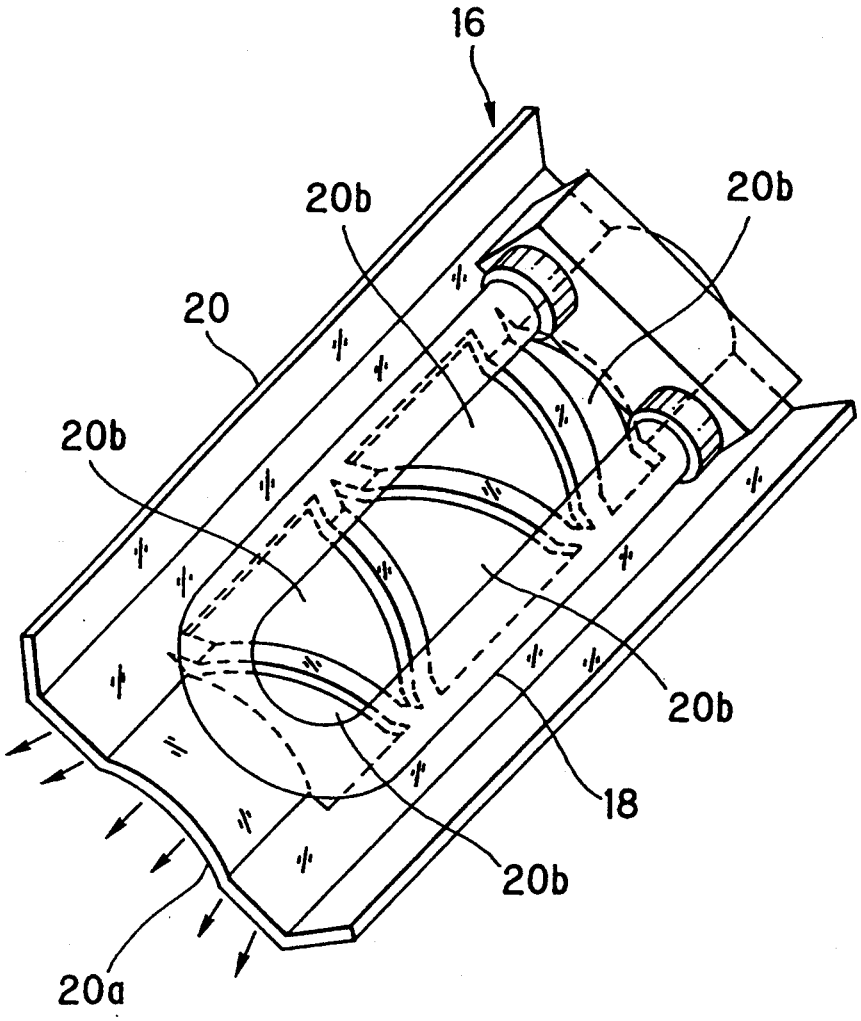
FIG. 3 is a perspective view of an optical fixing device according to another embodiment of the present invention, with a reflector thereof omitted for clarity.

Therefore, the optical fixing device 16 for magenta has an ultraviolet lamp 18 for radiating ultraviolet rays having an emission center wave length of 365 nm. The optical fixing device further has a reflector 19 surrounding the ultraviolet lamp 18, and a lamp cover member 20 attached to an open front end of the reflector 19. As shown in FIG. 3, an embodiment of the optical fixing device 16 is illustrated with the reflector 19 omitted for clarity, the ultraviolet lamp 18 is of a U-shape for efficiently projecting a large amount of light onto the recording paper 13.

The optical fixing device 17 for yellow has a construction equivalent to the optical fixing device 16 for magenta, and includes a U-shape ultraviolet lamp 21 for radiating ultraviolet rays of about 420 nm, a reflector 22 for accommodating the ultraviolet lamp 21, and a lamp cover member 23.

The lamp cover members 20 and 23 are provided for maintaining the recording paper 13, at a constant distance apart from the ultraviolet lamps 18 and 21 and for protecting the recording paper 13 from contacting the ultraviolet lamps 18 and 21 of the optical fixing devices 16 and 17, even when the recording paper 13 becomes loose on the platen drum 10. The lamp cover members 20 and 23 may have the same construction, and are advantageously made of an ultraviolet light permeable material. For example, a thermosensitive resin "RAV7" (trademark) which is produced by Mitsui Petrochemical Co., Ltd., is preferable as the ultraviolet permeable material.

Because the lamp cover members 20 and 23 may have the same construction, the embodiment of the lamp cover members 20 and 23 will be described hereinafter with respect to the lamp cover member 20 only, but the same description is applicable to the lamp cover member 23.

As shown in FIG. 3, the lamp cover member 20 has a semi-cylindrical recess 20*a* extending in the center of the lamp cover member 20 along the longitudinal direction thereof. When the optical fixing device 16 is set to the platen drum 10, the longitudinal direction of the optical fixing device 16 is oriented in a perpendicular manner to the paper transporting direction. Because the curve of the semi-cylindrical recess 20*a* is formed supplementary to the curve of the peripheral surface of the platen drum 10, it is possible to set the optical fixing device 16 sufficiently close to the platen drum 10.

Figure 4:
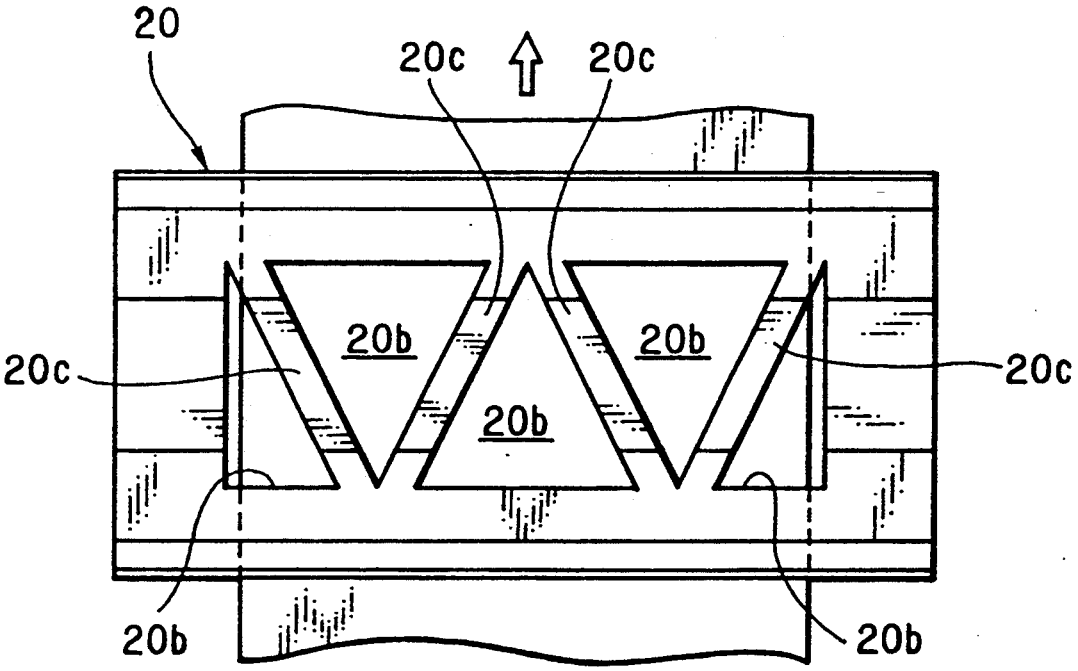
FIG. 4 is a plane view of a lamp cover member according to the embodiment of the present invention shown in FIG. 2.
Figure 5:
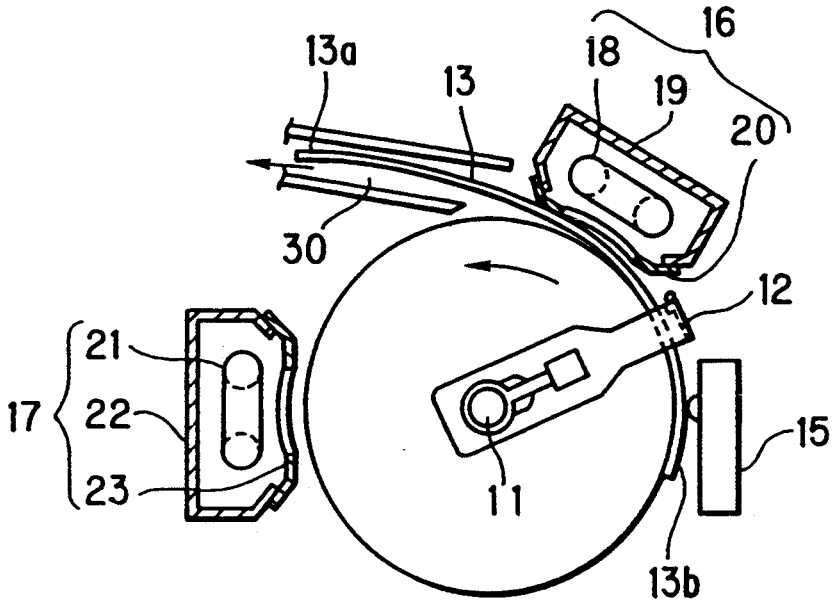
FIG. 5 is a view similar to FIG. 1, which shows a paper ejecting state of the direct color thermal printer.

According to the embodiment shown in FIGS. 3 and 4, the lamp cover member 20 further has a plurality of triangular openings 20*b* which are disposed side-by-side in a direction across the paper transporting direction. The triangular openings 20*b* reduce the amount of absorption of the ultraviolet rays into the lamp cover member 20, and bridge portions 20*c* between the triangular openings 20*b* protect the recording paper 13 from contacting the ultraviolet lamp 18. Because the bridge portions 20*c* extend obliquely to the paper transporting direction, unevenness of the fixing condition is prevented.

In other words, if the bridge portions 20*c* were oriented parallel to the paper transporting direction, the amount of the ultraviolet rays projected onto the recording paper 13 becomes partially large and partially small, because some parts of the recording paper 13 are always exposed directly to the ultraviolet rays through the triangular openings 20*b*, while other parts of the recording paper 13 are always exposed to those parts of the ultraviolet rays which have passed through the bridge portions 20*c*. Thereby, the ultraviolet rays traveling through the bridge portions 20*c* are reduced (about 20%) in intensity as compared with the ultraviolet rays traveling through the triangular openings 20*b*.

The operation of the above-described embodiment is as follows:

When the leading edge of a recording area of the recording paper 13 is placed into the print position by rotating the platen drum 10 in the paper transporting direction shown by the arrow, the thermal head 15 starts recording yellow pixels of a full-color image line by line in the yellow recording layer 8. That is, the heating elements of the thermal head 15 each generate an amount of heat energy which is controlled within a predetermined range, for instance, from 20 to 35 $mJ/mm^2$ according to densities of yellow pixels. The heat energy of this range develops the yellow recording layer 8.

Immediately before the clamp member 12 is placed under the optical fixing device 17 during the rotation of the platen drum 10 in the paper transporting direction, the ultraviolet lamp 21 is turned on. Then, near ultraviolet rays of about 420 nm are projected from the ultraviolet 21 onto the recording paper 13 through the lamp cover member 23. Thereby, the yellow recording layer 8 having the yellow pixels recorded thereon is optically fixed.

Because the trailing end 13b of the recording paper 13 is not secured to the platen drum 10, the recording paper 13 tends to become removed off of the platen drum 10 at the trailing end 13b, during the rotation of the platen drum 10. However, due to the bridge portions 20c of the lamp cover member 20, the recording paper 13 is maintained to be spaced apart from the ultraviolet lamp 21. Therefore, the magenta recording layer 7, which is not optically fixed, cannot be accidentally developed by heat energy radiated from the ultraviolet lamp 21.

When the recording paper 13 is transported to the print position for the second time, the thermal head 15 starts recording magenta pixels of the full-color image line by line on the magenta recording layer 7, by applying an amount of heat energy which is variable according to the color densities of the magenta pixels. Although the dynamic range of the heat energy for developing yellow, because the yellow recording layer 8 has already been fixed, the yellow recording layer 8 is not developed during the recording of magenta pixels.

Immediately before the clamp member 12 reaches the optical fixing device 17 for magenta during the second revolution of the platen drum 10, the ultraviolet lamp 18 of the optical fixing device 16 is turned on. Thereby, ultraviolet rays of about 365 nm are projected onto the recording paper 13 through the lamp cover member 20, to optically fix the magenta recording layer 7. At that time, the lamp cover member 20 also prevents the recording paper 13 from approaching too close to the ultraviolet lamp 18.

The ultraviolet lamp 21 is turned off immediately before the clamp member 12 is placed for the second time under the optical fixing device 17.

When the recording paper 13 is placed for the third time in the print position during the rotation of the platen drum 10, the thermal head 15 starts recording cyan pixels of the full-color image line by line on the cyan recording layer 6 by applying heat energy of a range higher than the range of the heat energy for developing the yellow and magenta recording layers.

Immediately after the start of cyan pixel recording, the clamp member 12 is released from the leading end 13a of the recording paper 13. Although the platen drum 10 continues to rotate in the paper transporting direction, the released clamp member 12 is caught by the stopper 14, and is stopped from rotating together with the platen drum. Thereby, the recording paper 13 is guided toward an ejection passage 30 during the cyan pixel recording.

Since the ultraviolet lamp 18 of the optical fixing device 16 is still on during the ejection of the recording paper 13, the leading end 13a of the recording paper 13 is exposed to the ultraviolet rays, so that the entire area of the recording paper 13 is optically fixed and bleached as a result.

Although the leading end 13a is removed off of the platen drum 10 toward the ultraviolet lamp 18 when the lamp member 12 is released, the lamp cover member 20 maintains the recording paper 13 spaced from the ultraviolet lamp 18. The lamp cover member 20 also prevents the leading end 13a from jamming into the optical fixing device 16.

Figure 6:
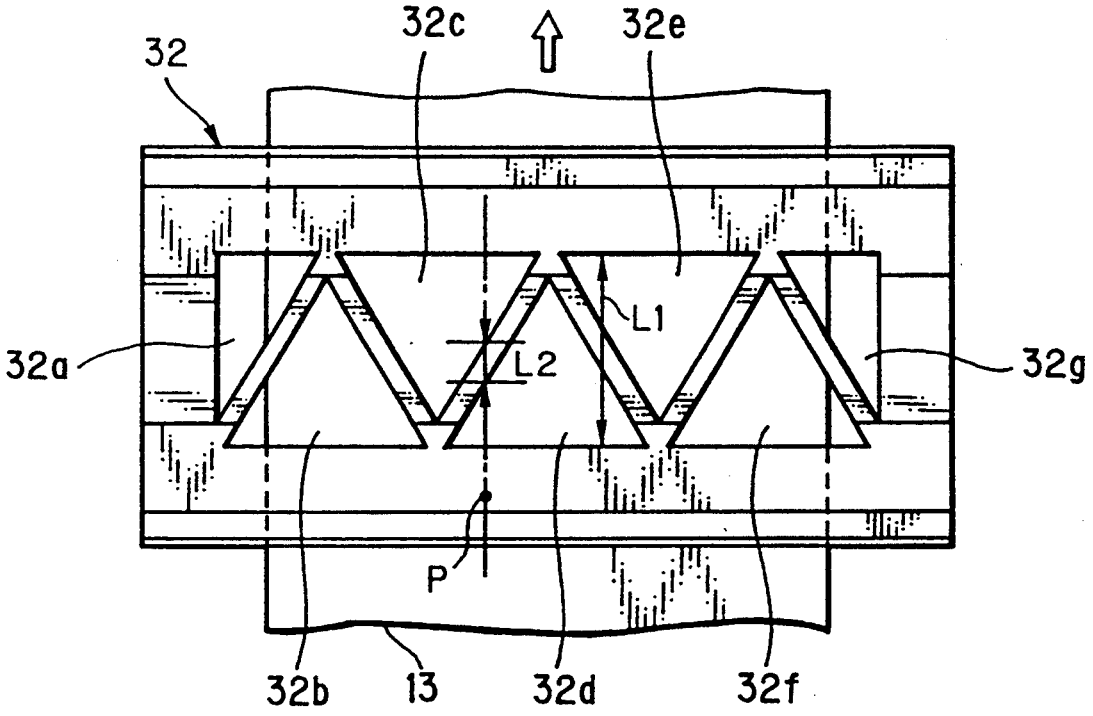
FIG. 6 is a plane view of a lamp cover member according to a further embodiment of the present invention.

FIG. 6 illustrates a lamp cover member 32 according to a further embodiment of the invention. The lamp cover member 32 is formed with triangular openings 32a to 32g, similarly to the lamp cover member 20, but the triangular openings 32a to 32g are arranged alternately. That is, the lateral edges of the triangular openings 32a to 32g are shifted from the vertexes of the adjacent openings in the paper transporting direction, such that an opening ratio $\alpha$ of the lamp cover member 32 is approximately equal in relation to any arbitrary point P of the recording paper 13 which crosses the lamp cover 32 in the paper transporting direction. Thereby, the uniformity of the fixing condition of the recording paper 13 is even more improved.

The opening ratio e of the lamp cover member 32 can be given by the following equation:

$$\alpha = \frac{L_1 - L_2}{L_1}$$

wherein $L_1$ is the distance between the lateral edges of the triangular openings 32a, 32c, 32e and 32g, on one hand, and the lateral edges of the triangular openings 32b, 32d and 32f, on the other hand; $L_2$ is the length by which any arbitrary point P of the recording paper 13 is transported under any one of the bridge portions between the triangular openings 32a to 32g, during the optical fixing. That is, any arbitrary point P of the recording paper 13 is shaped by any one of the bridge portions from the ultraviolet lamp 18 or 21 by the length $L_2$ while the point P is crossing the lamp cover member 32.

Therefore, the light amount M of ultraviolet rays projected onto any arbitrary point P of the recording paper 13 through the lamp cover member 32 during the optical fixing can be given by the following equation, on the premise that the light amount M is 100 if the optical fixing devices 16 and 17 have no lamp cover member:

$$\begin{aligned} M &= 100\alpha + 100(1-\alpha)k \\ &= 100\alpha + 100k - 100\alpha k \\ &= 100k + 100\alpha(1-k) \end{aligned}$$

wherein k is the transmittance for ultraviolet rays of the lamp cover member 32.

Because the light amount M is 100 k if the lamp cover member 32 has no opening, the triangular openings 32a to 32g increase the light amount M by an amount 100 $\alpha$ (1−k).

Figure 7:
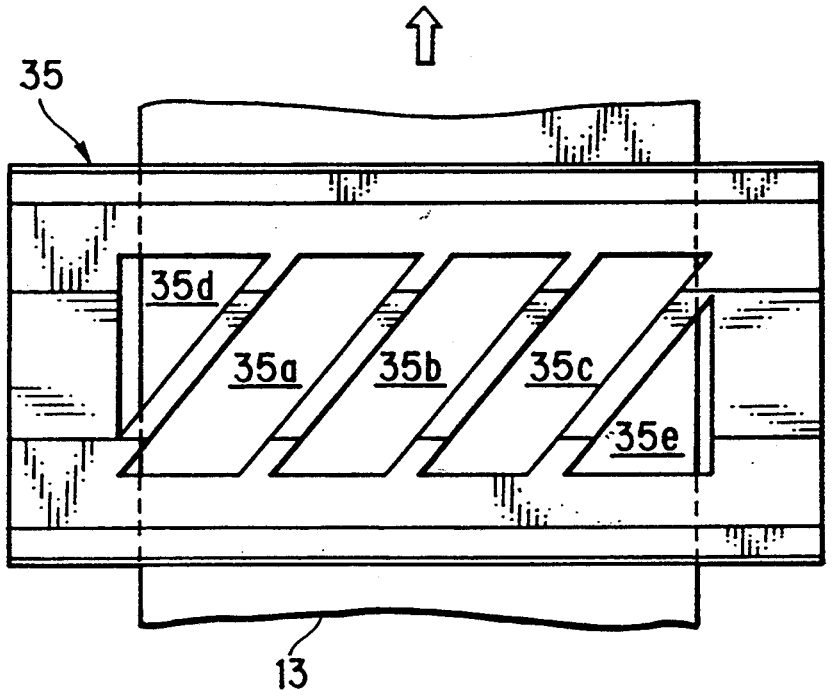
FIG. 7 is a plane view of a lamp cover member according to a still further embodiment of the present invention.

FIG. 7 illustrates a lamp cover member 35 according to a still further embodiment of the invention. The lamp cover member 35 is formed with openings 35a to 35c of a parallelogram shape which are disposed side-by-side in the transverse direction with respect to the paper transporting direction, and triangular openings 35d and 35e disposed on both sides of the parallelogram shaped openings 35a to 35c. The longitudinal edges of the openings 35a to 35e are oblique to the paper transporting direction, except for those edges which are disposed outside the recording paper transporting path.

In order to equalize the light amount of the ultraviolet rays totally projected onto the recording paper 13, it is preferable to define the inclination of the oblique edges of the openings 35a to 35e such that the light amount projected onto the recording paper 13 in the direction orthogonal to the paper transporting direction is as equal as possible. Other constructions may be equivalent to the lamp cover member 20 shown in FIG. 3.

It should be noted that the shape of the openings of the lamp cover member may be other than the shape of a triangle or a parallelogram. For example, the openings may be of a circular or a rhombic shape.

Although the present invention has been described with respect to the direct color thermal printer, it is, of course, possible to apply the present invention to a monochromatic direct thermal printer.

Furthermore, the present invention is applicable to serial printers wherein pixels are serially printed by a two-dimensional movement of the recording medium relative to the thermal head, although the above embodiments only relate to line printers wherein the recording medium is moved linearly in a secondary scanning direction relative to the thermal head whose heating elements are aligned in a primary scanning direction which is orthogonal to the secondary scanning direction.

The lamp cover member is not necessarily made of materials having permeability to ultraviolet light, but it is possible to use another resin material, such as ABS or APS, or a metallic material for the lamp cover member.

It is also possible to provide a reflection layer on the inner or outer surface of the ultraviolet lamp of the optical fixing device. Thereby, a separate reflector is not necessary.

Thus, the present invention is not intended to be limited by the above-described embodiment but, on the contrary, various modifications of the present invention can be effected without departing from the spirit and scope of the appended claims.

What is claimed is:

1. A thermal printer comprising:

a thermal head for thermally recording an image on a thermosensitive recording medium;

an optical fixing lamp for projecting electromagnetic rays onto said thermosensitive recording medium to optically fix said thermosensitive recording medium; and a lamp cover member disposed between said optical fixing lamp and said thermosensitive recording medium, said lamp cover member including a plurality of openings having edges extending in directions excluding a first direction in which said thermosensitive recording medium is moved relative to said optical fixing lamp.

2. A thermal printer as recited in claim 1, further comprising a platen drum for transporting said thermosensitive recording medium to said thermal head and said optical fixing lamp, and a clamp member for securing said thermosensitive recording medium to a peripheral surface of said platen drum, wherein said thermal head and said optical fixing lamp are disposed around said platen drum.

3. A thermal printer as recited in claim 2, wherein said lamp cover member is a plate-shaped member, which is formed with a recess extending through said lamp cover member in a second direction orthogonal to said first direction, said recess having a curve supplementary to said peripheral surface of said platen drum.

4. A thermal printer as recited in claim 3, wherein said plurality of openings are of a triangular shape and arranged in said second direction, such that a first edge of each of said openings of said triangular shape extends in said second direction and said openings of said triangular shape are alternately reversed in direction.

5. A thermal printer as recited in claim 4, wherein said openings of said triangular shape are alternately shifted from one another in said first direction, such that a light amount projected onto said thermosensitive recording medium is uniform in said second direction.

6. A thermal printer as recited in claim 3, wherein said plurality of openings are of a parallelogram shape which are arranged in said second direction, and a first pair of parallel edges of each of said openings of said parallelogram shape extend obliquely to said first direction.

7. A thermal printer as recited in claim 1, further comprising a reflector surrounding said optical fixing lamp from a rear of said optical fixing lamp, wherein said lamp cover member is attached to an open front end of said reflector.

8. A thermal printer as recited in claim 1, wherein said optical fixing lamp is U-shaped.

9. A thermal printer as recited in claim 1, wherein said electromagnetic rays comprise ultraviolet rays.

10. A thermal printer as recited in claim 1, wherein said lamp cover member comprises an ultraviolet light permeable material.

11. A method for recording images on a thermosensitive recording medium by a thermal printer, comprising the steps of:

(a) thermally recording an image on the thermosensitive recording medium by a thermal head;

(b) projecting electromagnetic rays onto the thermosensitive recording medium by an optical fixing lamp to optically fix the thermosensitive recording medium;

(c) disposing a lamp cover member between said optical fixing lamp and the thermosensitive recording medium; and (d) forming a plurality of openings in said lamp cover member which have edges extending in directions excluding a first direction in which the thermosensitive recording medium is moved relative to said optical fixing lamp.

12. A method as recited in claim 11, further comprising the steps of:

(e) transporting the thermosensitive recording medium by a platen drum to said thermal head and said optical fixing lamp;

(f) securing the thermosensitive recording medium to a peripheral surface of said platen drum; and (g) disposing said thermal head and said optical fixing lamp around said platen drum.

13. A method as recited in claim 12, further comprising the steps of:

(j) forming said lamp cover member to have a plate-shaped member with a recess extending therethrough in a second direction orthogonal to said first direction; and (k) forming a curve supplementary to said peripheral surface of said platen drum in said recess.

14. A method as recited in claim 13, wherein said plurality of openings are formed at said step (d) of a triangular shape and arranged in said second direction so that a first edge of each of said openings of said triangular shape extends in said second direction and said openings of said triangular shape are alternately reversed in direction.

15. A method as recited in claim 14, wherein said openings of said triangular shape are alternately shifted from one another in said first direction so that a light amount projected onto the thermosensitive recording medium is uniform in said second direction.

16. A method as recited in claim 13, wherein said plurality of openings are formed at said step (d) of a parallelogram shape and arranged in said second direction and a first pair of parallel edges of each of said openings of said parallelogram shape extend obliquely to said first direction.

17. A method as recited in claim 11, further comprising the steps of:

(h) surrounding said optical fixing lamp from a rear of said optical fixing lamp with a reflector; and (i) attaching said lamp cover member to an open front end of said reflector.

* * * * *